US005778876A

United States Patent [19]

Gorin

[11] Patent Number: 5,778,876

[45] Date of Patent: Jul. 14, 1998

[54] SELF-CONTAINED OXYGEN REBREATHER WITH SEMI-PERMEABLE MEMBRANE TO VENT EXCESS HELIUM

[75] Inventor: Steve Gorin, Panama City, Fla.

[73] Assignee: The United States of America as represented by the Secretary of the Navy, Washington, D.C.

[21] Appl. No.: 803,207

[22] Filed: Feb. 11, 1997

[51] Int. Cl.[6] ..... A62B 7/10; A62B 19/00; A62B 23/02; B63C 11/02

[52] U.S. Cl. ..... 128/205.12; 128/201.27; 128/204.28; 128/205.13; 128/205.17

[58] Field of Search ..... 128/201.25–201.28, 128/204.18, 204.21, 204.22, 204.26, 204.28, 204.29, 205.11–205.17, 205.22, 205.27

[56] References Cited

U.S. PATENT DOCUMENTS

| | | | |
|---|---|---|---|
| 3,957,043 | 5/1976 | Shelby | 128/203.14 |
| 5,315,988 | 5/1994 | Clarke et al. | 128/205.13 |
| 5,503,145 | 4/1996 | Clough | 128/205.11 |

FOREIGN PATENT DOCUMENTS

| | | | |
|---|---|---|---|
| 1326293 | 3/1963 | France | 128/205.12 |
| 1363935 | 5/1964 | France | 128/205.12 |
| 170471 | 2/1960 | Sweden | 128/205.12 |

*Primary Examiner*—Kimberly L. Asher
*Attorney, Agent, or Firm*—Harvey A. Gilbert

[57] ABSTRACT

A self-contained underwater breathing loop apparatus for an oxygen rebreather includes a breathing bag formed to act as a compliant volume and a semipermeable membrane arranged to divide the breathing bag into a first chamber and a second chamber. A breathing hose is connected between a mouthpiece and the first chamber of the breathing bag to conduct exhaust breath from the diver thereto. The semi-permeable membrane is formed to allow helium in the diver's exhaust breath to pass therethrough while preventing oxygen in the exhaust breath from being transported from the first chamber into the second chamber. A relief valve in the second chamber allows helium in the second chamber to be expelled into the water. A $CO_2$ scrubber is in fluid communication with the first chamber of the breathing bag. A helium supply in fluid communication with the $CO_2$ scrubber for supplying helium to the breathing loop through a metering valve. The helium supply preferably may be manually controlled by the diver to add helium in controlled amounts to the breathing loop to permit the diver to descend to a greater depth.

12 Claims, 1 Drawing Sheet

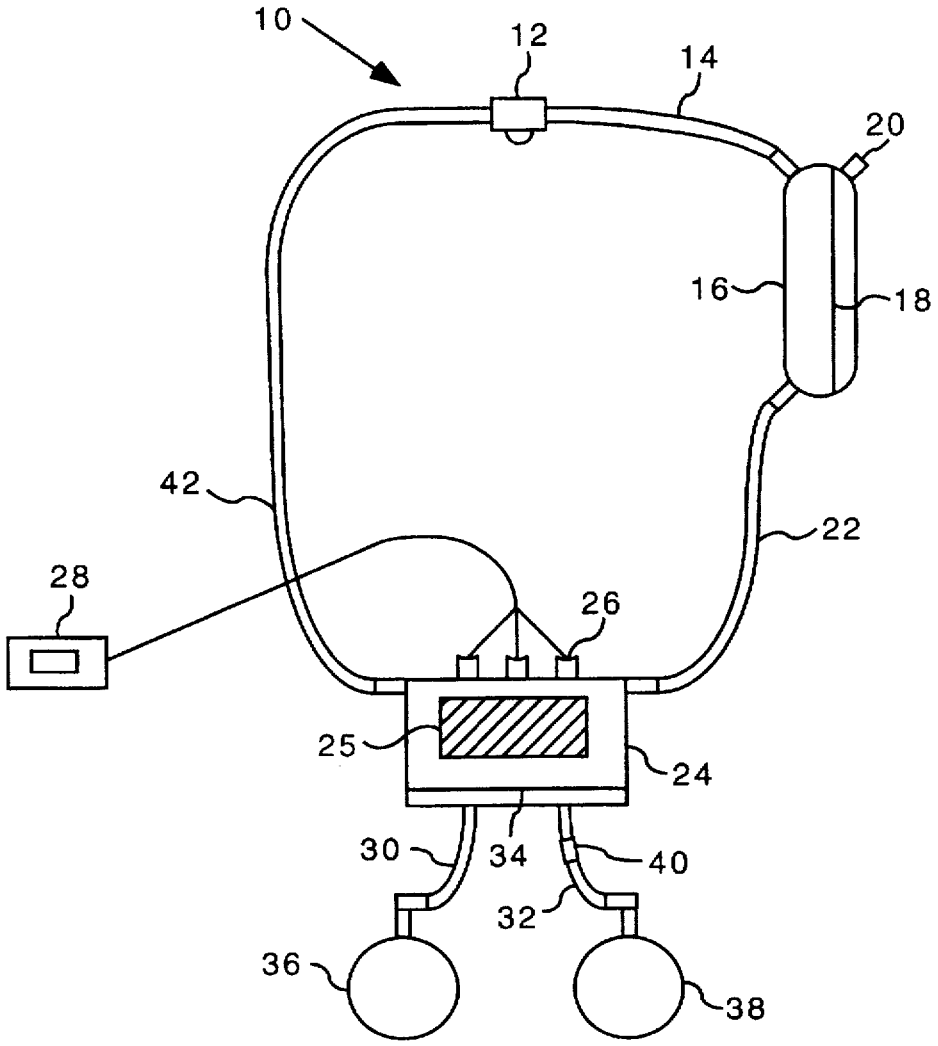
10
12
14
20
16
18
42
22
28
26
25
24
30
34
40
32
36
38

SELF-CONTAINED OXYGEN REBREATHER WITH SEMI-PERMEABLE MEMBRANE TO VENT EXCESS HELIUM

BACKGROUND OF THE INVENTION

1. Field of the Invention

This invention relates generally to oxygen rebreathers for use as an underwater breathing apparatus and particularly to a modification of the apparatus to allow divers to descend to greater depths without increasing the complexity of the breathing apparatus significantly. More particularly, this invention relates to the addition of a helium supply and a semipermeable membrane in the breathing bag to remove the helium from the closed system.

2. Description of the Prior Art

Various underwater breathing systems are well-known in the art. Self Contained Underwater Breathing Apparatus (SCUBA) presently in use by the United States Navy can be divided into four categories: (1) open circuit, (2) closed circuit, mixed gas, (3) semi-closed circuit, mixed gas, and (4) closed-circuit, pure oxygen.

An open circuit underwater breathing system is inappropriate for many military applications because it produces a conspicuous gas trail that renders it inappropriate for clandestine operations. Furthermore, the gas supply is large and bulky, which inhibits mobility and distance swimming.

Several mixed gas underwater breathing systems are currently in use, although they provide extended diving duration and closed-circuit capabilities, they are large, heavy, complex, and expensive to maintain. One of the major reasons for the complexity of mixed gas rebreathers is that they utilize electronic control of the oxygen content. This requires the use of sensors and the logic control of an oxygen add valve significantly increasing the complexity of the system. For these reasons, only highly trained personnel are capable of maintaining and operating such systems. A further drawback of mixed gas rebreathers is the difficulty in supporting them logistically in remote locations due to their inherent complexity.

Semi-closed circuit mixed gas rebreathers are also available, but are not used by United States military divers. They are more complex than oxygen rebreathers, but less complex than closed circuit mixed gas rebreathers. Because semi-closed circuit mixed gas rebreathers off-gas, they are not appropriate for clandestine uses. Furthermore, gas concentrations vary significantly with workload and depth conditions, which makes critical decompression calculations difficult.

The apparatus most commonly used by clandestine military divers is the oxygen rebreather. An oxygen rebreather is a simple closed-circuit breathing apparatus that supplies 100% oxygen to a diver in a compact and easy-to-maintain system. An oxygen rebreather permits extended dive duration and does not have the disadvantages associated with mixed gas systems. Advantages inherent in this type of underwater breathing apparatus over open-circuit and semi-closed circuit underwater breathing systems include a complete lack of off-gas from the underwater breathing apparatus by which the diver might be detected. Furthermore, the compact size and conservation of gas supply inherent in the oxygen rebreather results in longer underwater operating times. Advantages over closed-circuit mixed-gas underwater breathing systems include compact size and reduced maintenance requirements.

A significant disadvantage of prior oxygen rebreathers is the severe limitation on the depths to which the diver could descend before the increased partial pressure causes the oxygen to become toxic.

SUMMARY OF THE INVENTION

The present invention provides an okygen breathing system that allows deeper diving than previous systems by including a mixed-gas excursion capability. The present invention allows the diver to have the benefits of both a pure oxygen rebreather and the benefits of a mixed gas system in a simpler easy to operate, easy to maintain system.

A self-contained underwater breathing loop apparatus for an oxygen rebreather according to the present invention may suitably comprise, consist of, or consist essentially of the following discussed elements including a breathing bag formed to act as a compliant volume and a semipermeable membrane arranged to divide the breathing bag into a first chamber and a second chamber. A first breathing hose is connected between the mouthpiece and the first chamber of the breathing bag to conduct exhaust breath from the diver thereto. The semipermeable membrane is formed to allow helium in the diver's exhaust breath to pass therethrough while preventing oxygen in the exhaust breath from being transported from the first chamber into the second chamber. A relief valve in the second chamber allows helium in the second chamber to be expelled into the water.

The underwater rebreathing apparatus according to the present invention preferably further includes a $CO_2$ scrubber in fluid communication with the first chamber of the breathing bag and a helium supply in fluid communication with the $CO_2$ scrubber for supplying helium to the breathing loop. A metering valve means controls the amount of helium added to the $CO_2$ scrubber from the helium supply. The helium supply preferably may be manually controlled by the diver to add helium to the breathing loop to permit the diver to descend to a greater depth.

The underwater rebreathing apparatus according to the present invention preferably further includes a volume diaphragm and a $CO_2$ scrubber located in a scrubber housing for determining when there is less than a predetermined volume of oxygen in the breathing loop and an oxygen supply in fluid communication with the $CO_2$ scrubber for supplying oxygen thereto when the volume diaphragm determines that there is less than the predetermined volume of oxygen in the breathing loop. The present invention, and its objects, advantages, and benefits will be more fully understood when the drawing is considered in conjunction with the detailed description which follows.

BRIEF DESCRIPTION OF THE DRAWING

The FIGURE illustrates a self-contained underwater breathing loop for an oxygen rebreather with mixed gas excursion capability.

DESCRIPTION OF THE PREFERRED EMBODIMENT

Referring to the FIGURE, a self-contained underwater breathing loop 10 for an oxygen rebreather with mixed gas excursion capability includes a mouthpiece 12 connected to two breathing hoses 14 and 46. A first breathing bag 16 is connected between the breathing hose 14 and a first connection hose 22. A scrubber housing 24 containing a $CO_2$ scrubber element 25 and a volume diaphragm 34 on the downstream side of scrubber 24 is connected between the breathing hoses 22 and 42. The scrubber 24 connects to a helium supply 38 with a connection hose 32 and metering valve 40. An oxygen supply 36 is connected to the scrubber 24 via a connection hose 30. An oxygen sensor array 26 is connected between the scrubber 24 and a display module 28 that provides data necessary for monitoring the operation of the breathing loop 10.

Beginning at the diver interface with the mouthpiece 12, the diver's exhaled breath is transported through the breathing hose 14 to the breathing bag 16. The breathing bag 16 acts a compliant volume and is divided by a semi-permeable membrane 18. The semi-permeable membrane 18 allows helium from the diver's exhaust breath to pass therethrough and be expelled into the water through a relief valve 20. Oxygen is not transported through the semi-permeable membrane 18 and stays in the breathing loop 10.

From the breathing bag 16, oxygen is transported through the connection hose 22 to the scrubber 24 which contains the CO2 scrubber element 25 which removes $CO_2$ from the breathing gas. The oxygen sensor 26 senses the partial pressure of oxygen in the loop 10. The oxygen partial pressure information is displayed for the diver by the display module 28.

The oxygen supply 36 with connection hose 30 and a helium supply 38 with a connection hose 32 and a metering valve 40 are attached to the scrubber 24 for the addition of $O_2$ and He to the breathing loop 10. The oxygen supply 36 releases oxygen into the system through connection hose 30 when a reduced volume of $O_2$ exists as determined by a volume diaphragm 34. The helium supply 38 releases helium into the system manually through connection hose 32 and the metering valve 40 when the diver wishes to descend to greater depths. The helium is metered by the metering valve 40 to release a known volume of helium into the system.

The breathing gas passes through the connection hose 42 from the scrubber housing 24 to the mouthpiece 12 and the diver.

The operational advantage of this system over a standard oxygen rebreather is to allow the diver to go deeper without threat of oxygen toxicity. This can be done with a mixed gas rebreather, but the rebreather apparatus according to the present invention would be less expensive, much simpler, and more easily maintained. The essential new features to this breathing loop 10 are the addition of the semi-permeable membrane 18 into the breathing bag 16 for elimination of helium and the metered helium supply 38 to add a known amount of helium to the breathing loop 10. Helium has been selected as the adjunct gas to make it more easily removed from the loop 10. The semi-permeable membrane 18 allows the elimination of gas from the breathing loop 10 simply without the need for complicated high maintenance equipment. The gas can be removed from the breathing loop 16 at a fairly slow rate so that the diver does not continually need to add helium.

The structures and methods disclosed herein illustrate the principles of the present invention. The invention may be embodied in other specific forms without departing from its spirit or essential characteristics. The described embodiments are to be considered in all respects as exemplary and illustrative rather than restrictive. Therefore, the appended claims rather than the foregoing description define the scope of the invention. All modifications to the embodiments described herein that come within the meaning and range of equivalence of the claims are embraced within the scope of the invention.

What is claimed is:

1. A self-contained underwater breathing loop apparatus for an oxygen rebreather for use by a diver via a mouthpiece, comprising:

a compliant means for providing containment for a volume of breathing gas exhaust;

means for separating one gas from a multi-gas flow, said means arranged to divide said compliant means into a first chamber and a second chamber;

a flexible means for communicating said exhaust gas from said mouthpiece to the first chamber of said compliant containment means to conduct exhaust breath from the diver thereto, said separation means formed to allow helium in the diver's exhaust breath to pass therethrough while preventing oxygen in the exhaust breath from being transported from said first chamber into said second chamber; and a control means connecting from outside to inside said second chamber for allowing helium in said second chamber to be expelled into the water.

2. The apparatus of claim 1 further comprising:

a means for removing $CO_2$, said means in fluid communication with said first chamber of said containment means;

a means for supplying helium to said breathing loop, said supply means in fluid communication with said $CO_2$ removal means; and a metering means for controlling the amount of helium added to said $CO_2$ removing means from said helium supply means.

3. The apparatus of claim 2 wherein the means for supplying helium is manually controlled by said diver.

4. The apparatus of claim 2, further comprising:

means located in said $CO_2$ removal means for determining when there is less than a predetermined volume of oxygen in said $CO_2$ removal means; and a means for supplying oxygen, said oxygen supplying means in fluid communication with said $CO_2$ removal means for supplying oxygen thereto when said volume determining means determines that there is less than the predetermined volume of oxygen in said $CO_2$ removal means.

5. A self-contained underwater breathing loop apparatus for an oxygen rebreather for use by a diver via a mouthpiece, comprising:

a breathing bag formed to act as a compliant volume;

a semipermeable membrane arranged to divide the breathing bag into a first chamber and a second chamber;

a first breathing hose connected between the mouthpiece and the first chamber of the breathing bag to conduct exhaust breath from the diver thereto, the semipermeable membrane being formed to allow helium in the diver's exhaust breath to pass therethrough while preventing oxygen in the exhaust breath from being transported from the first chamber into the second chamber; and a relief valve in the second chamber formed for allowing helium in the second chamber to be expelled into the water.

6. The apparatus of claim 5, further comprising:

a $CO_2$ scrubber in fluid communication with the first chamber of the breathing bag;

a helium supply in fluid communication with the $CO_2$ scrubber for supplying helium to the breathing loop; and metering valve means for controlling the amount of helium added to the $CO_2$ scrubber from the helium supply.

7. The apparatus of claim 6 wherein the helium supply is manually controlled by the diver to add helium to the breathing loop to permit the diver to descend to a greater depth.

8. The apparatus of claim 6, further comprising:

a volume diaphragm in the $CO_2$ scrubber for determining when there is less than a predetermined volume of oxygen in the $CO_2$ scrubber; and an oxygen supply in fluid communication with the $CO_2$ scrubber for supplying oxygen thereto when the volume diaphragm determines that there is less than the predetermined volume of oxygen in the $CO_2$ scrubber.

9. A method for forming a self-contained underwater breathing loop apparatus for an oxygen rebreather for use by a diver via a mouthpiece, comprising the steps of:

forming a breathing bag to act as a compliant volume;

arranging a semipermeable membrane for dividing the breathing bag into a first chamber and a second chamber;

connecting a first breathing hose between the mouthpiece and the first chamber of the breathing bag to conduct exhaust breath from the diver thereto;

forming the semipermeable membrane for allowing helium in the diver's exhaust breath to pass therethrough while preventing oxygen in the exhaust breath from being transported from the first chamber into the second chamber; and placing a relief valve in the second chamber for allowing helium in the second chamber to be expelled into the water.

10. The method of claim 9, further comprising the steps of:

placing a $CO_2$ scrubber in fluid communication with the first chamber of the breathing bag;

placing a helium supply in fluid communication with the $CO_2$ scrubber for supplying helium to the breathing loop; and controlling the amount of helium added to the $CO_2$ scrubber from the helium supply.

11. The method of claim 10 including the step of providing manual control of the helium supply by the diver to add helium to the breathing loop to permit the diver to descend to a greater depth.

12. The method of claim 10, further comprising the steps of:

determining when there is less than a predetermined volume of oxygen in the $CO_2$ scrubber; and placing an oxygen supply in fluid communication with the $CO_2$ scrubber for supplying oxygen thereto when there is less than the predetermined volume of oxygen in the $CO_2$ scrubber.

* * * * *